US012692608B2

(12) United States Patent
Jacobs et al.

(10) Patent No.: US 12,692,608 B2
(45) Date of Patent: Jul. 28, 2026

(54) CARBON FREE GAS DIFFUSION ELECTRODE

(71) Applicant: VITO NV, Mol (BE)

(72) Inventors: Ben Jacobs, Mol (BE); Deepak Pant, Mol (BE); Diane Van Houtven, Mol (BE); Erwin Maes, Mol (BE); Jan Vaes, Mol (BE); Yuvraj Y. Birdja, Mol (BE)

(73) Assignee: VITO NV, Mol (BE)

( * ) Notice: Subject to any disclaimer, the term of this patent is extended or adjusted under 35 U.S.C. 154(b) by 540 days.

(21) Appl. No.: 18/014,827

(22) PCT Filed: Jul. 7, 2021

(86) PCT No.: PCT/EP2021/068896
§ 371 (c)(1),
(2) Date: Jan. 6, 2023

(87) PCT Pub. No.: WO2022/013042
PCT Pub. Date: Jan. 20, 2022

(65) Prior Publication Data

US 2023/0313392 A1 Oct. 5, 2023

(30) Foreign Application Priority Data

Jul. 14, 2020 (EP) ..... 20185780

(51) Int. Cl.
*C25B 11/032* (2021.01)
*C25B 11/071* (2021.01)

(52) U.S. Cl.
CPC ..... *C25B 11/032* (2021.01); *C25B 11/071* (2021.01)

(58) Field of Classification Search
CPC ..... C25B 11/032; C25B 11/071; C25B 1/23; C25B 1/27; C25B 3/03; C25B 3/07; C25B 11/091; C25B 11/055; Y02E 60/50
See application file for complete search history.

(56) References Cited

U.S. PATENT DOCUMENTS

| | | | | |
|---|---|---|---|---|
| 4,568,442 | A | 2/1986 | Goldsmith | |
| 2019/0256990 | A1* | 8/2019 | Kaczur | C25B 3/26 |
| 2020/0131649 | A1* | 4/2020 | Krause | C25B 11/031 |

FOREIGN PATENT DOCUMENTS

WO 2015139129 A1 9/2015

OTHER PUBLICATIONS

Tang et al. Advantages of Eutectic Alloys for Creating Catalysts in the Realm of Nanotechnology-enabled Metallurgy. Nature Communications Oct. 1-14, 2019; (Year: 2019).*

(Continued)

*Primary Examiner* — Luan V Van
*Assistant Examiner* — Randall Lee Gamble, Jr.
(74) *Attorney, Agent, or Firm* — Dinsmore & Shohl LLP

(57) ABSTRACT

The present invention relates to a novel approach of obtaining a gas diffusion electrode (GDE), the gas diffusion electrodes obtained using said method and the use thereof in the electrocatalytic conversion of gaseous reactants into economically interesting reaction products. The GDEs obtained using the method of the present invention are particularly useful in the electrochemical of gaseous reactants such as CO2, H2, N2, or O2 into bulk chemicals and fuels such as Syngas, Formic Acid, Methanol, Ethanol, Ethane, Ethylene, Methane, Ammonia, and the like.

8 Claims, 8 Drawing Sheets

(56) References Cited

OTHER PUBLICATIONS

International Search Report and Written Opinion mailed Oct. 15, 2021 in reference to co-pending Application No. PCT/EP2021/068896 filed Jul. 7, 2021.
Omrani, et al., "Gas diffusion later modifications and treatments for improving the performance of proton exchange membrane fuel cells and electrolysers: A review", Science Direct, vol. 42, pp. 28515-28536, 2017.
Min, et al., "Review of flash sintering: materials, mechanisms and modelling", Advances in Applied Ceramics: vol. 116, No. 1, pp. 24-60, Jan. 2, 2017, XP055846992.

* cited by examiner

CARBON FREE GAS DIFFUSION ELECTRODE

CROSS REFERENCES TO RELATED APPLICATIONS

This application is a national-stage application under 35 U.S.C. § 371 of International Application No. PCT/EP2021/068896, filed Jul. 7, 2021, which International Application claims benefit of priority to European Patent Application No. 20185780.2, filed Jul. 14, 2020.

FIELD OF THE INVENTION

The present invention relates to a novel approach of obtaining a gas diffusion electrode (GDE), the GDEs obtained using said method and the use thereof in the electrocatalytic conversion of gaseous reactants into economically interesting reaction products. The GDEs obtained using the method of the present invention are particularly useful in the electrochemical conversion of gaseous reactants such as $CO_2$, $H_2$, $N_2$, or $O_2$ into bulk chemicals and fuels such as Syngas, Formic Acid, Methanol, Ethanol, Ethane, Ethylene, Methane, Ammonia, and the like.

BACKGROUND TO THE INVENTION

The invention comprises the development of a Gas Diffusion Electrode (GDE) to be used in electrolyzers to efficiently convert gaseous reactants such as $CO_2$, $H_2$, $N_2$ or $O_2$ electrochemically to (commodity) reaction products. The electrocatalytic conversion of these small molecules is promising in view of renewable energy storage (RES) and electrification of the chemical industry.

A GDE is a combination of porous structures exhibiting a hydrophilic and a hydrophobic side. It is generally composed of a catalyst layer (CL), a gas diffusion layer (GDL) and a current collector (CC) as shown in FIG. 1. A GDE allows the direct supply of gases via the hydrophobic side to the liquid medium where electrochemical processes take place. Because of their low mass transfer resistance, the use of GDEs is promising for electrochemical processes with gaseous reactants. Because of their high porosity, GDEs have a reactive surface area much larger than their geometrical area (projected surface area), which is favorable for the process productivities. The GDL is a porous medium that facilitates transport of gaseous reactants to and gaseous products from the CL and consists of a macro-porous layer either with or without a micro-porous layer (MPL). A wide variety of GDL parameters have been investigated to enhance electrolyzer or fuel cell performance (Omrani R, Shabani B (2017) Gas diffusion layer modifications and treatments for improving the performance of proton exchange membrane fuel cells and electrolysers: A review. Int J Hydrogen Energy 42:28515-28536. doi: 10.1016/j.ijhydene.2017.09.132).

The industrial or large-scale implementation of GDEs is currently however hindered by moderate current densities, large overpotentials (thus low energetic efficiency) and poor stability of the electrode structure. The required overpotential for a given electrode half reaction is determined by a number of factors:

1. the intrinsic electrocatalytic activity of the electron donor/acceptor material and the specific reaction pathway(s) that can occur on the surface (electrocatalyst)
2. the local and surface concentrations of all species that take part or influence the charge transfer steps.

For a complete redox (cell) system, one needs to consider both anode and cathode reactions and add the resistive parts of the electrolyte (ionic resistance) and the contacts (electronic conductance), all a function of the resulting (or applied) current density. Also, the stability of GDEs is still underexplored leading to little insight in degradation mechanisms.

The Following Aspects of GDEs can be Considered as Bottlenecks:

- Little availability of catalytic sites due to inactive (carbon) support material in the catalyst layer leading to relatively low faradaic efficiency and partial current density
- Difficulty to control the porosity of the GDL
- Conductivity is strongly dependent on type and amount of carbon support. If activated carbon is used, incorporation of an additional current collector into the GDE (see FIG. 1) is needed which may for example reduce the selectivity of $CO_2R$ (generating more $H_2$). If a graphite support is used, the conductivity is better, however the obtained current is lower due to lower specific surface area of graphite)
- Electrode production includes a catalyst coating step in the support material which complicates the manufacturing of the electrode (throughput, uniform quality) as well as its scale-up.
- GDEs for emerging technologies such as electrochemical reduction of $CO_2$ and $N_2$, and biomass oxidation are not durable with long term instability of the GDL. Moreover, it is unclear what causes the instability.

The main problem that is solved by the GDEs of the present invention is that significantly larger partial currents can be obtained since no carbon support is used. Moreover, the availability of catalytically active species is significantly increased since the Catalytic Layer is not spray coated onto the support material but, as further detailed hereinafter, forms a homogeneous porous structure with the material of the GDL of which the porosity, conductivity and catalyst can be controlled and tuned. As the nature of the catalytically active material can easily be changed, the GDE of this invention can be adapted for use in various electrocatalytic reactions e.g. $CO_2$ reduction, $N_2$ reduction, $O_2$ reduction, etc.

With the new GDE the current densities are strongly enhanced without a decrease in Faradaic efficiency or stability.

SUMMARY OF THE INVENTION

The present invention is based on the finding that assembly of a Gas Diffusion Electrode (GDE) can greatly be simplified by integration of the Catalyst Layer in the Gas Diffusion Layer. It has been found that the typical integration of a layer of a conductive carbon support for the catalytic material can be omitted in the design of the GDEs according to the invention. Said GDEs are characterized in that the catalytically active material is mixed with, integrated in and distributed over the porous material of the Gas Diffusion Layer (GDL), and accordingly allows omission of a separate Catalyst Layer (CL) typically found in GDEs. Expressed differently, in the GDEs of the instant application, the GDL and the Catalytic Layer are combined in one single layer, hereinafter also referred to as the Catalytically Active Gas Diffusion Layer (CAGDL).

As will be further detailed hereinafter, the CAGDL may be manufactured by mixing the catalytic material with the base materials making up the porous GDE in the absence of a conductive carbon support for the catalytic material, followed by exposing the mixture comprising the base material and the catalytic material to an electrochemical activation step, thereby realizing the CAGDL. This electrochemical activation step involves Joule heating of the composition by curing the mixture of the catalytic material with the material(s) making up the porous material of the gas diffusion layer (GDL). The thus activated GDL is hereinafter also referred to as the sintered GDL. The base materials making up a porous GDL typically include a porous binder, hereinafter also referred to as a porous binder support material or binder material, optionally further comprising pore forming materials, i.e. materials that enable the formation of pores in the base material, such as ammonium bicarbonate (ambic), which forms pores in the porous binder support material upon curing, but lacks the carbon conductive support typically found in GDEs. In one embodiment the catalytic material is admixed with said pore forming material when added to the base materials, i.e. the porous binder support material making up the GDL.

Thus in a first aspect the present invention provides a GDE comprising an Catalytically Active Gas Diffusion Layer (CAGDL) characterized in that catalytic material is distributed within the porous support matrix of the Gas Diffusion Layer in the absence of a conductive carbon support. In principle any porous binder material known to be used in the manufacture of the GDL of GDEs can be used, but in one embodiment the binder material is a polymeric porous material, in particular a thermoplastic porous material, such as polytetrafluoroethylene (PTFE). In one embodiment the binder material is preferably a polymeric material such as one or more polymers selected from the group of polyvinylidine fluoride (PVDF), polyvinyl alcohols, polystyrenes, organic silicates, aliphatic silanes, or any other polymer or organic material having the desired properties, and present in particle form (over the entire range of available molecular weights for polymer materials). The particulate polymer or organic material may be used either as a powder, a dispersion of particles, a suspension of particles, or any other heterogeneous mixture comprising the particles.

In one embodiment, the catalytic material used in the GDEs comprises a low melting point metal having a melting point below 800° C., such as Sn, Cd, Zn, Pb, Sb, Bi or eutectic compositions therefore, i.e. Ag—Cu 779, Sn—Bi and the like. In the manufacture of the CAGDL, this catalytic material is preferably mixed as a metallic powder with the polymeric binder material. Arguably such GDL materials can be found to exist, but will always require the presence of a current collector, e.g. a central metal screen of Indium plated tin in US 2019/256990 or a stainless steel mesh in WO2015/139129) or of a metal carrier that acts as current distributer admixed into the materials making up the GDE, in order to provide sufficient electrical conductivity to the GDE. The present invention is based on the finding that an activation of the GDL's as herein disclosed, allows them to be used directly as CAGDL's, i.e. even in the absence of an additional current collector or current distributor while exhibiting sufficient electrical conductivity. As will be apparent from the examples, the CAGDL's have undergone a structural modification, including melting and sintering of metal particles (such as Sn particles) followed by recrystallization leading to nanostructured metal particles (e.g. Sn) present in the activated GDL's (also referred to as CAGDL) and a more porous morphology, yielding a significant reduction in resistance and a significant increase in current at a given potential. It is accordingly an object of the present invention to provide a Gas Diffusion Electrode (GDE) comprising a Catalytic Activated Gas Diffusion Layer (CAGDL), wherein the CAGDL layer consists of an electrochemically sintered Gas Diffusion Layer (GDL) comprising a catalytic material homogenously distributed within the GDL, said GDL further comprising a porous binder material and, characterized in that said catalytic material is present within the sintered GDL in the absence of a conductive carbon support for said catalytic material, and in the catalytic material is present within the sintered GDL as nanostructured particles. The nanostructured particles are typically characterized in all three dimensions of said particles being in the nanoscale, in particular with an average length range of approximate 1 nm to 100 nm; in particular with an average length range of approximate 10 nm to 100 nm; in particular with an average length range of approximate 20 nm to 100 nm; even more in particular with an average length range of approximate 30 nm to 100 nm; in an even further embodiment with an average length range of approximate 40 nm to 100 nm.

In a second aspect the present invention provides a method of manufacturing a GDE comprising a CAGDL according to the invention, said method including mixing a catalytic material with material(s) typically used in the manufacture of the porous support matrix of a GDL, and exposing the thus obtained composition to an electrochemical activation step, thereby realizing the CAGDL. In one embodiment of realizing the CAGDL, a powder of the catalytic material is mixed with a material that provides/may be transformed into the porous binder support matrix for the catalytic material particles. The method of manufacturing may in a preferred embodiment further include a curing step and an electrochemical activation step. In one embodiment the electrochemical activation involves Joule heating of the composition obtained by mixing the catalytic material with the base material(s) making the porous GDL as herein described; with the purpose of producing an electrically conductive CAGDL.

As further detailed hereinafter, the Joule activation includes applying a potential to said mixture; in particular of the cured mixture; comprising the catalytic material, the binder material(s) and the optional pore former until the current reaches absolute values around or larger than 1 $A/cm^2$.

BRIEF DESCRIPTION OF THE DRAWINGS

FIG. 3 Linear Sweep Voltammograms of three Pb GDEs in a microflowcell for;

a first Pb GDE: grey+(untreated) black+(treated);

a second Pb GDE: grey □ (untreated) black □ (treated);
a third Pb GDE: grey Δ (untreated) black Δ (treated)

Figure 4A:
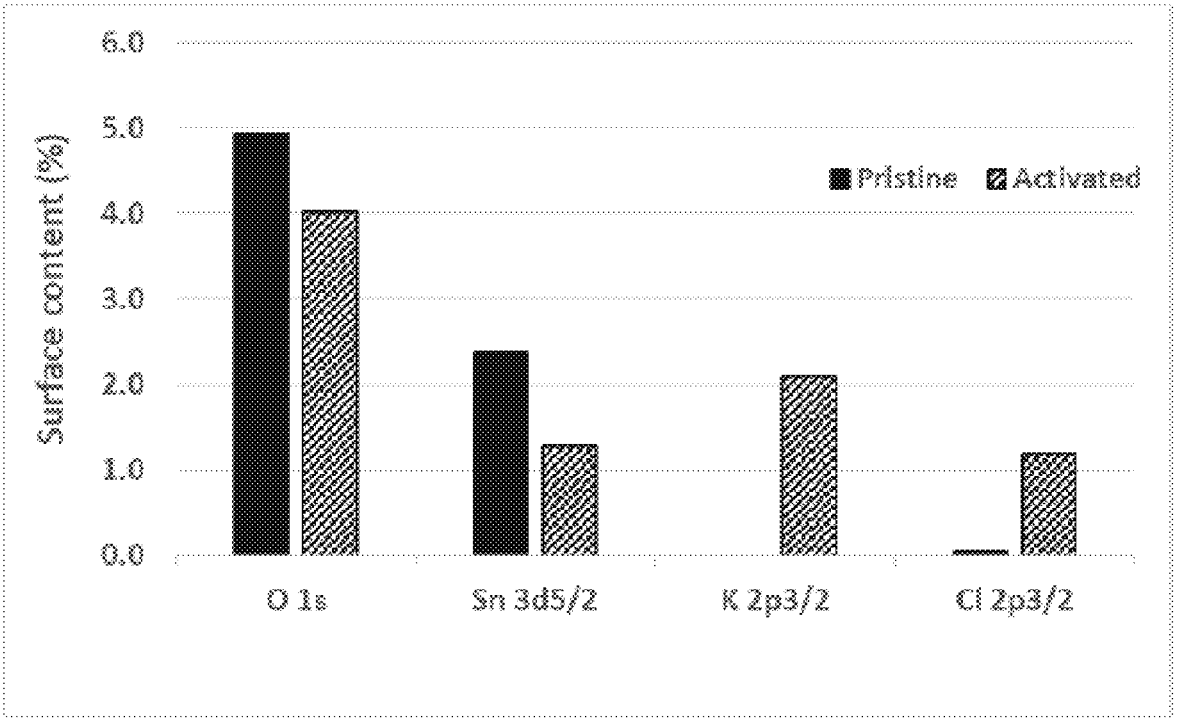
Figure 4B:
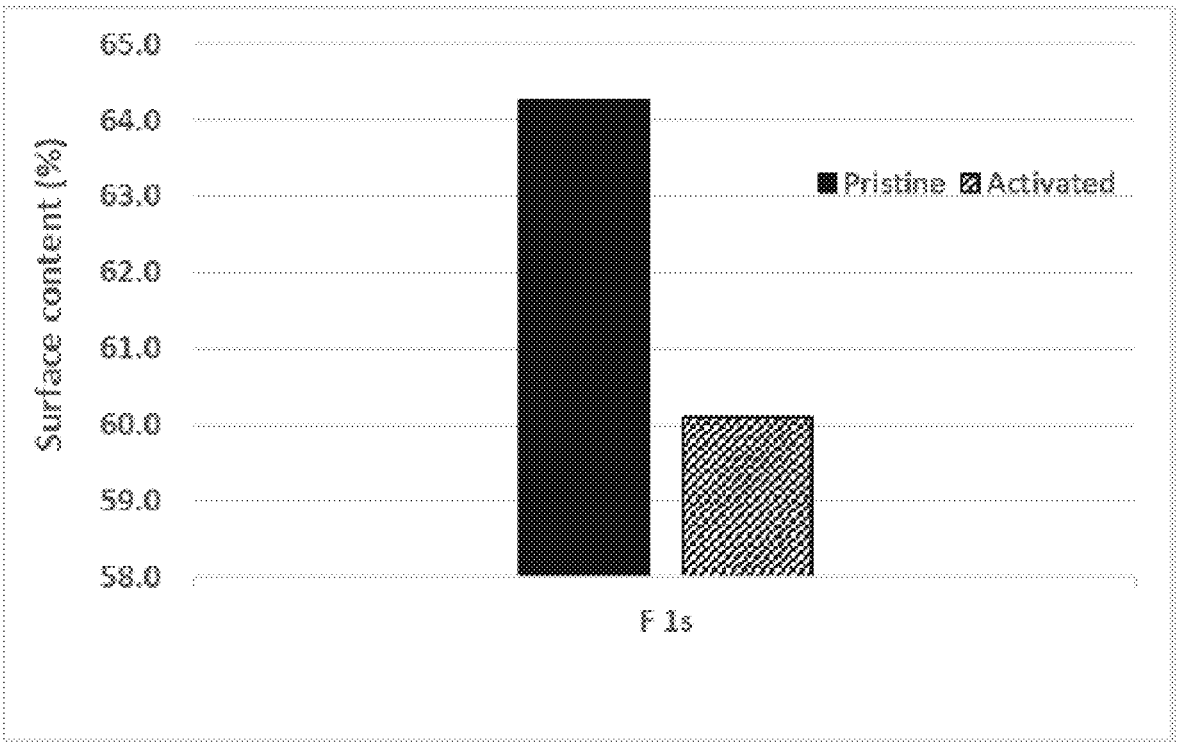
Figure 5:
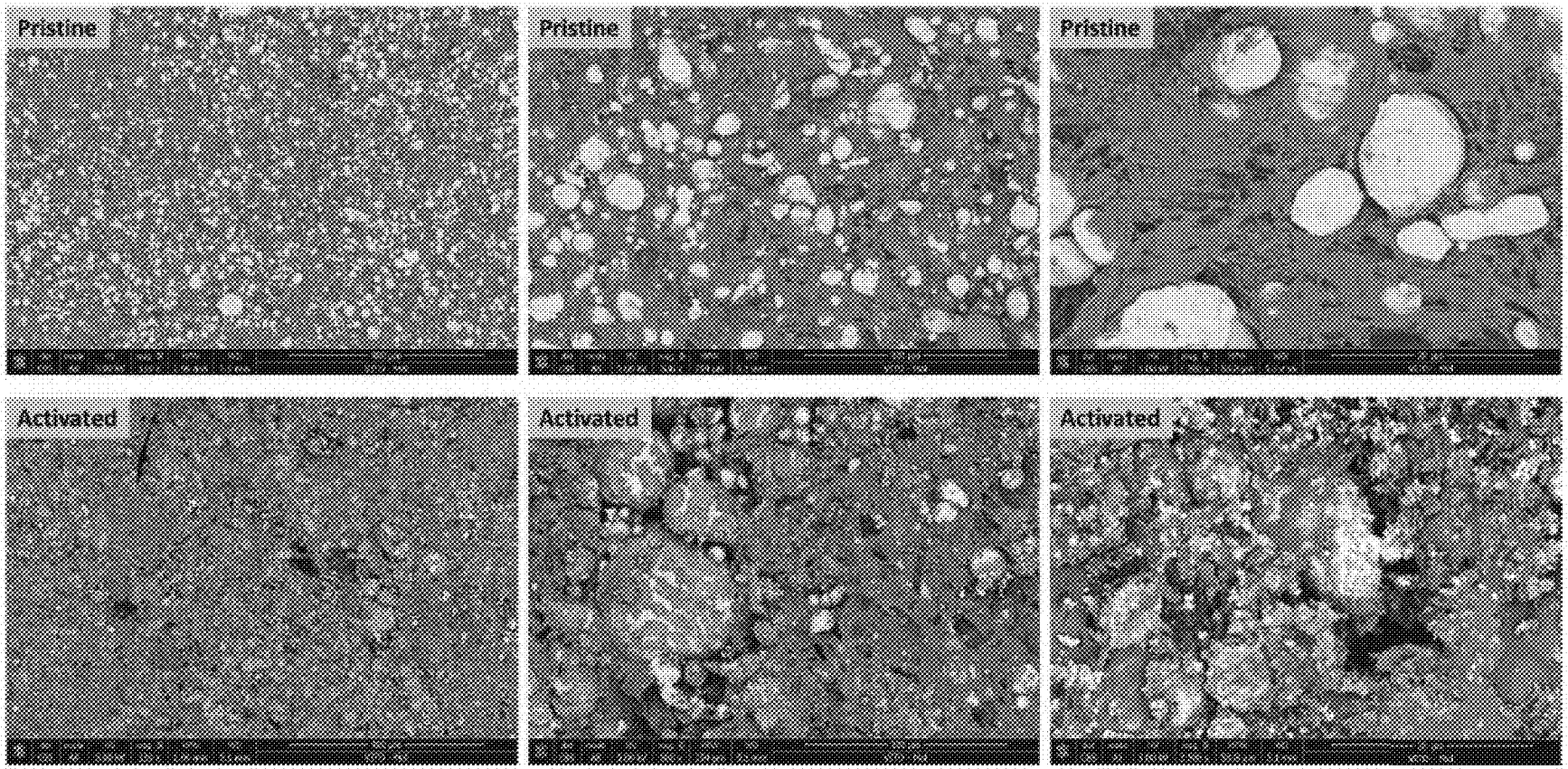

FIG. 4 Surface content of O, Sn, K and Cl (left) and F (right) for pristine and activated Sn GDE based on XPS analysis FIG. 5 SEM images of a pristine Sn GDE (top) and an activated Sn GDE (bottom) at 120×, 500× and 2500× magnification according to the invention.

DETAILED DESCRIPTION OF THE INVENTION

The porous material for the gas diffusion layer of the invention is based on a polymeric porous binder material or porous inorganic binder material with the polymeric porous binder material preferred over the porous inorganic material, similar to the materials typically used in the GDL of a GDE, but characterized in the absence of a conductive carbon support for the catalytic material. As mentioned herein before, in a standard GDE, the catalytic material is applied onto a carbon support material. In the CAGDL of the present invention, such carbon support is not required, instead the catalytic materials is admixed directly with the materials used in the manufacture of the GDL, and exposed to an electrochemical activation step, i.e. activation by Joule heating realizing the required electrical conductivity. The polymeric porous binder material can be selected from foams, bundled fibers, matted fibers, needled fibers, woven or nonwoven fibers, porous polymers made by pressing polymer beads, Porex and Porex like polymers. Suitable polymer materials include, i. e. porous polyolefins such as porous polyethylene or porous polypropylene which can be prepared by blending two polymers and removing one of the polymers by dissolving it. The porous polymeric material is preferably selected from bundled fibers, matted fibers, needled fibers, and woven or nonwoven fibers. More preferably, the porous polymeric material is selected from nonwoven felts, woven fibers or bundles of fibers made of polyamide such as nylon, polyethylene, polypropylene, polyester such as polyethylene terephthalate, cellulose, modified cellulose such as Rayon, polyacrylonitrile, and mixtures thereof. Other suitable porous polymeric materials include polyvinylidine fluoride (PVDF), polytetrafluoroethylene (PTFE), polyvinyl alcohols, polystyrenes, organic silicates, aliphatic silanes, or any other polymer. Besides the afore-mentioned polymeric materials, the binder material may comprise or be made of an organic material having the desired properties, in particle form over the entire range of available molecular weights for polymer materials either as a powder, dispersion, suspension, or any other heterogeneous mixture.

The porous binder material of the CAGDL will preferably have a porosity in the range of about 5 to about 150 pores per inch (ppi), and a density in the range of about 0.5 to about 8.0 pounds per cubic foot.

The porous material can be of any physical shape as long as it has at least one flat surface for making contact with one of the electrodes when the gas diffusion layer is installed in for example a fuel cell, or any other surface suitable for establishing a desired contact with the electrode. Thus, for example when the porous material of a GDL of the invention comprises a foam such as a flexible reticulated polyurethane foam, the foam can be of any physical shape when not compressed and not installed in a fuel cell as long as the foam, uncompressed or compressed, has at least one surface adapted for making contact with an electrode when installed in a fuel cell.

In the manufacture of the Catalytically Active Gas Diffusion Layer (CAGDL), this binder material, and in particular the polymeric binder material is admixed with the catalytic material. In one embodiment, the particulate polymeric binder material is admixed with the catalytic material and with a pore forming material, i.e. a material that enables the formation of pores in the polymeric binder material, such as ammonium bicarbonate (ambic), and the like. In a preferred embodiment a powder of the particulate polymeric binder material is admixed with a powder of the catalytic material and with a powder of the pore forming material.

A powder is a dry, bulk solid composed of many very fine particles that may flow freely when shaken or tilted. Powders are a sub-class of particulate materials and refers to those particulate materials that have the finer grain sizes, and that therefore have a greater tendency to form clumps when flowing. As a general rule any discrete particles whose sizes are less than 1 mm are called powders.

For example, in one embodiment bulk powder (commercial) of the catalytic material is mixed with a powdery binder material, preferably a powdery polymeric binding agent, such as polytetrafluoroethylene (PTFE). The pore former, e.g. ambic is also added to this mix. In a subsequent step this mixture will be shaped be it by cold rolling, stepwise pressing, agglomeration, or combinations thereof.

In the examples hereinafter the powder materials were mixed together as they were, (step wise so heat by friction was not produced). In preparing the mixtures, it is important to try and obtain homogenous mixtures. In particular the catalytic materials should be distributed as homogenously as possible in the mixture of particulate powders materials used in the manufacture of the CAGDL. 'Homogenous' as used herein implies the same in all directions, i.e. having the same density and of the same kind or substance, respectively. Homogenously particulate material blending techniques are known in the art and rely on a vigorous mixing of at least two feed streams, such as for example using high shear vertical mixers, high shear horizontal pin or ring mixers, low shear drum mixers or fluidised bed systems. These mixtures were then either pressed slowly and in steps (5 Ton, 10 Ton, 15 Ton), or pressed into a cake, such as for example using a hydraulic press of 20 Ton and cold-rolled to the investigated thickness. In one embodiment the cold-rolling is effected in various rolling-steps of which the amount lies by preference between 10 μm and 50 μm, especially between 30 μm and 45 μm. In a preferred embodiment the cold-rolling is biaxial rolling as such rolling treatment increases the surface area and strengthens the mechanical cohesion of the CADGL. In such biaxial rolling every rolling-step is effected with a rolling-direction which is turned 90 degree with respect to the rolling-direction of the former step.

The homogeneity of the mixture can be enhanced by pre-treatment of the particulate/powdery components, i.e. of the polymeric binder support, the catalytic material, and the pore forming material, in order to get a mixture homogenous in particle size. Such treatment could be a size selection of the source materials, but equally consist of grinding the source materials and/or the mixture, e.g. on laboratory scale in a blender. With the objective of realizing CAGDL as thin as a couple of mm's, the average particle size of the powdery components is preferably smaller than 1 mm.

Both the cake and the cold-rolled layer can be used as a CAGDL in the electrode as evident from the examples hereinafter. In either instance the last step in the manufacture of the CAGDL is a curing step wherein the cake pressed or cold-rolled layer is placed in an oven to sublimate the pore former from the composition, such as overnight at 70° C. to sublimate the pore former Ambic which creates the pores in the material. Once cured, the electrode material is exposed to an electrochemical activation procedure, i.e. by Joule Heating to achieve the Catalytic Activated Gas Diffusion Layer (CAGDL). As detailed in the examples hereinafter, the Joule heating can occur via different procedures but commonly includes applying a potential at the electrode material until the current reaches absolute values around or larger than 1 A/cm$^2$. To realize the Joule heating, the potential can be applied; (1) by applying a constant potential at the electrode material for a time until the current reaches absolute values around or larger than 1 A/cm$^2$; (2) by cycling the potential within a specific potential range for numerous cycles until the current reaches values around 1 A/cm$^2$; or (3) by applying potential pulses or steps to values large enough such that the current increases to values larger than around 1 A/cm$^2$. In the examples (FIG. 2A) potentials of −1 V or more negative were applied at the cured electrode material. In a particular embodiment a potential in a range of about and between −2 V and −30 V is applied; more in particular a potential in a range of about and between −2 V and −10 V is applied. The voltage across the material can be applied at a constant value over time until the current reaches the aforementioned values, but alternatively the potential across the material can be applied in pulses or incremental steps. The duration of the pulses or steps can be between 1 microsecond and 100 seconds, in particular between 100 milliseconds and 500 milliseconds, and are repeated until the current reaches absolute values larger than 1 A/cm$^2$. The number of voltage pulses can be in a range between 1 pulse and 1000 pulses; in particular between 1 and 500 pulses, more in particular between 1 and 100 pulses. The potential of the pulses or steps is typically in the range between −2 V and −30 V. A more negative potential may lead to destruction of the electrode due to large temperature generated during the process. The time needed for the activation of the electrode depends on the combination of the aforementioned parameters (pulse/step time, pulse/step potential and number of pulses/steps). In another embodiment the potential is cycled within two values between −2 V and −30 V leading to an increased current for each step until absolute values larger than 1 A/cm$^2$ are obtained. The time to realize a fully activated electrode is dependent on the chosen potential window, scan rates and number of cycles. Generally high scan rates are used (0.5-2 A/s). The key for this activation procedures is to realize large currents which enable a sintering process via the Joule effect leading to an increased conductivity of the electrode.

The skilled person is well aware of power sources that can be used to apply a constant voltage or voltage pulses/steps across the cured electrode materials as herein provided. Such power source could for example consists of a DC voltage source, optionally including a controller to set the duration of the voltage pulses/steps or number of cycles.

In the mixtures used for the manufacture of the CAGDL layers according to the invention, high Faradaic Efficiency (FE) values are obtained in case of an excess of the catalytic material with respect to the binder material. A typical weight % ratio of catalytic material (e.g. metal powders)/pore former/binder material (e.g. PTFE) of 70/20/10 for the electrode in the formic acid synthesis hereinafter resulted in a FE>80%. Other ratio's for the amount of catalytic material with respect to the amount of pore former and binder in the range of 50% to 80% wt of catalytic material were also tested with the same FE for formic acid synthesis. It accordingly follows that in one embodiment according to the invention the CAGDL comprises 50% to 80% wt of catalytic material with respect to the amount of binder and/or pore former material. In one embodiment the CAGDL comprises from about 50%-80% wt of catalytic material; from about 10%-40% wt of pore former; and from about 10%-40% wt of binder. In one embodiment the CAGDL comprises from about 50%-80% wt of catalytic material; from about 10%-40% wt of pore former; and about 10% wt of binder. In another embodiment from about 50%-80% wt of catalytic material; from about 10%-40% wt of pore former; and from about 10%-20% wt of binder. In another embodiment from about 60%-80% wt of catalytic material; from about 10%-20% wt of pore former; and from about 10%-20% wt of binder. In another embodiment from about 60%-80% wt of catalytic material; from about 10%-20% wt of pore former; and about 10% of binder. In another embodiment from about 50%-80% wt of catalytic material; from about 10%-40% wt of pore former; and about 10% of binder. In another embodiment from about 60%-75% wt of catalytic material; from about 15%-30% wt of pore former; and about 10% of binder. In a particular embodiment from about 60%-75% wt of catalytic material; about 20% wt of pore former; and about 10% of binder. In all of the tested combinations 20% ambic gave the best result.

Mixtures used in the manufacture of the CAGDL typically include pore forming materials, i.e. materials that enable the formation of pores in the base material, such as ammonium bicarbonate, ambic, which forms pores in the porous binder support matrix upon curing. The particle size of such pore forming materials will inevitably influence the pore sizes formed in the CAGDL. Within the examples the pore former is sieved in an air sieve, so the powder size is in a range around 0.4 μm, with a corresponding porosity in the CAGDL with pore sizes in the range of 0.33±0.18 μm.

The composition of the CAGDL comprises the catalytic material in a porous binder matrix. The catalytic material includes, but is not limited to corrosion-resistant metallic materials such as, but not limited to, metallic carbides, metallic nitrides, metallic borides, metallic silicates, metallic oxides, or any combinations thereof. Metalloid powders may also be used. When manufacturing the CAGDL, the catalytic materials may be used in different forms, but preferably they are used in the form of particles of the catalytic material. All of these materials may be purchased commercially in a variety of particle sizes. Desirably, substrate particle-sizes of the catalytic material should be no more than 1 mm, but preferably no more than 500 μm; in particular up to 150 μm. Preferably, the metallic powder is mixed with a material that serves as the porous binder for the catalytic particles. The porous binder material is preferably a mildly hydrophobic or hydrophilic material such as polyvinylidine fluoride (PVDF), a polyvinyl alcohol, polystyrene, an organic modified? silicate, an aliphatic silane, or any other polymer or organic material having the desired properties. The material preferably is purchased as a raw ingredient in particle form (over the entire range of available molecular weights for polymer materials) and may for example take the form of a powder, dispersion, suspension, or any other heterogeneous mixture. The average particle size of the particulate components is preferably smaller than 1 mm. Size of the support-binder particles should be no less than 0.01 μm and no more than 1 mmm, but preferably between 1 μm and 50 μm, more in particular between and about 6 μm to 20 μm. As mentioned hereinbefore, the pore forming material is also included as a particulate constituent to the mixture in the manufacture of the CAGDL and will determine the porosity of said layer. Size of the pore former particles should be no less than 0.01 μm and no more than the size of the support-binder material. In one embodiment the particle size of the pore former is between and about 0.01 μm to 10 μm, in particular up to about 2 μm. Within the examples the pore former is sieved in an air sieve, so the powder size is in a range around the 0.4 μm, with a corresponding porosity in the CAGDL with pore sizes in the range of 0.33±0.18 μm. As used herein, particle sizes for the catalytic material, the binder and the pore former are meant to refer to average particle sizes.

As mentioned herein before, the gas diffusion electrode of this invention is produced by mixing a catalytic material with the material(s) used in the manufacture of a gas diffusion layer, but characterized in that the catalytic material is not applied onto a carbon support material, and exposing the thus obtained porous material to an electrochemical activation step, thereby realizing the CAGDL. The hypothesis is that Joule heating causes 'flash' sintering of the catalytic material, leading to increased electrical conductivity and catalytic active surface area. Scanning Electron Microscopy (SEM) images of the GDE before and after activation clearly shows a conversion of the initial microscale catalytic materials into nanostructured particles. The result for such activation of a Gas Diffusion Layer obtained according to the methods as herein described has been proven for Sn (melting point of about 230° C.), Sn—Zn alloy (melting point of about 200° C.) and Pb (melting point of about 330° C.) as catalytic materials in the absence of a carbon support.

GDEs based on other catalytic materials (with low melting point Sn (±230° C.), Cd (±320° C.), Zn (±420° C.), Pb (±330° C.), Sb (±630° C.), Bi (±270° C.) or low melt eutectic compositions such as 55.5% Bi–44.4% Sn (±125° C.) will undergo a similar increase in electrical conductivity and catalytic surface area, through the conversion of the catalytic material into nanostructured particles. Consequently, in one embodiment according to the invention, the catalytic material is a low melting point metal, i.e. having a melting point below 800° C., in particular having a melting point below 450° C.; more in particular having a melting point below 350° C., for use in the manufacture of a CAGDL as herein provided.

As will become evident from the examples hereinafter, the invention has been tested for the electrochemical conversion of carbon dioxide but can equally be used in the design of gas diffusion electrodes for other electrochemical conversion of gaseous reactants such as $H_2$, $N_2$ or $O_2$ to (commodity) reaction products. In the examples below, the $CO_2$ reduction to products, using low melting point metals were investigated by the inventors. Conventionally, for $CO_2$ to formic acid, Sn particles are used frequently as catalyst. The invention for this particular purpose is a Sn based porous GDE structure without support material leading to an increased surface area without compromising the electrocatalytic activity of $CO_2R$ i.e. the Faradaic efficiency to formic acid has not decreased. Similarly, another set of experiments proved enhanced current densities using Pb as a catalyst for conversion of $CO_2$ to oxalate.

Moreover, the porosity is controlled by the amount of pore forming material (e.g. ammonium bicarbonate) and different pore sizes can be realized by changing the particle size of the pore forming material (e.g. ammonium bicarbonate) which is used in the production process.

It has been found that the conductivity of this carbon-free GDE comprising a CAGDL is strongly increased when compared to traditional GDEs wherein the catalytic material is coated on a carbon-support, which together with the enhanced catalytic surface area (see the structural modification that follows after the Joule heating) of the GDE leads to an increase of current densities by a factor 15-50. A derived advantage is the scalability of these GDEs that have become much easier to fabricate and cheaper overall.

EXAMPLES

Preparation GDE

A gas diffusion layer was prepared by physically mixing ammonium bicarbonate and PTFE in a 30:70 weight ratio. The mix was pressed with a pressure of 0.1 t/cm$^2$ and the resulting cake was calendared to a thickness of 0.5 mm. The catalyst layer was prepared by mixing a Sn or Pb powder, PTFE and ammonium bicarbonate in a weight ratio of respectively 70:10:20 and 78:7:15. The mix was pressed with a pressure of 0.1 t/cm$^2$ and the resulting cake was calendared to a thickness of 0.5 mm. The two layers were fixed together by calendaring them together, down to a total thickness of 0.6 mm. The electrode was consequently kept at 105° C. overnight to decompose the ammonium bicarbonate.

Figure 1:
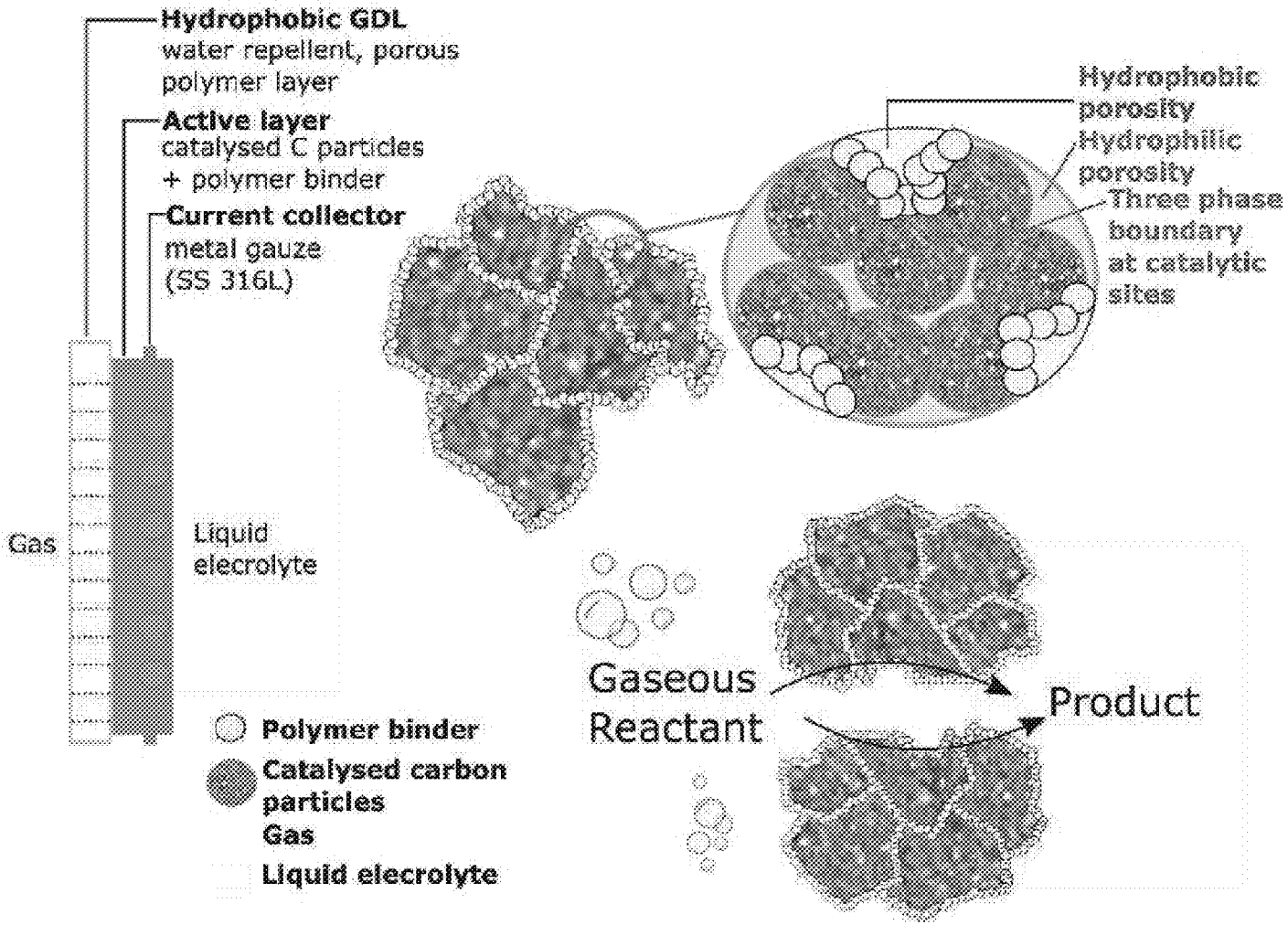
FIG. 1. Schematic diagram of a prior art Gas Diffusion Electrode
Figure 2A:
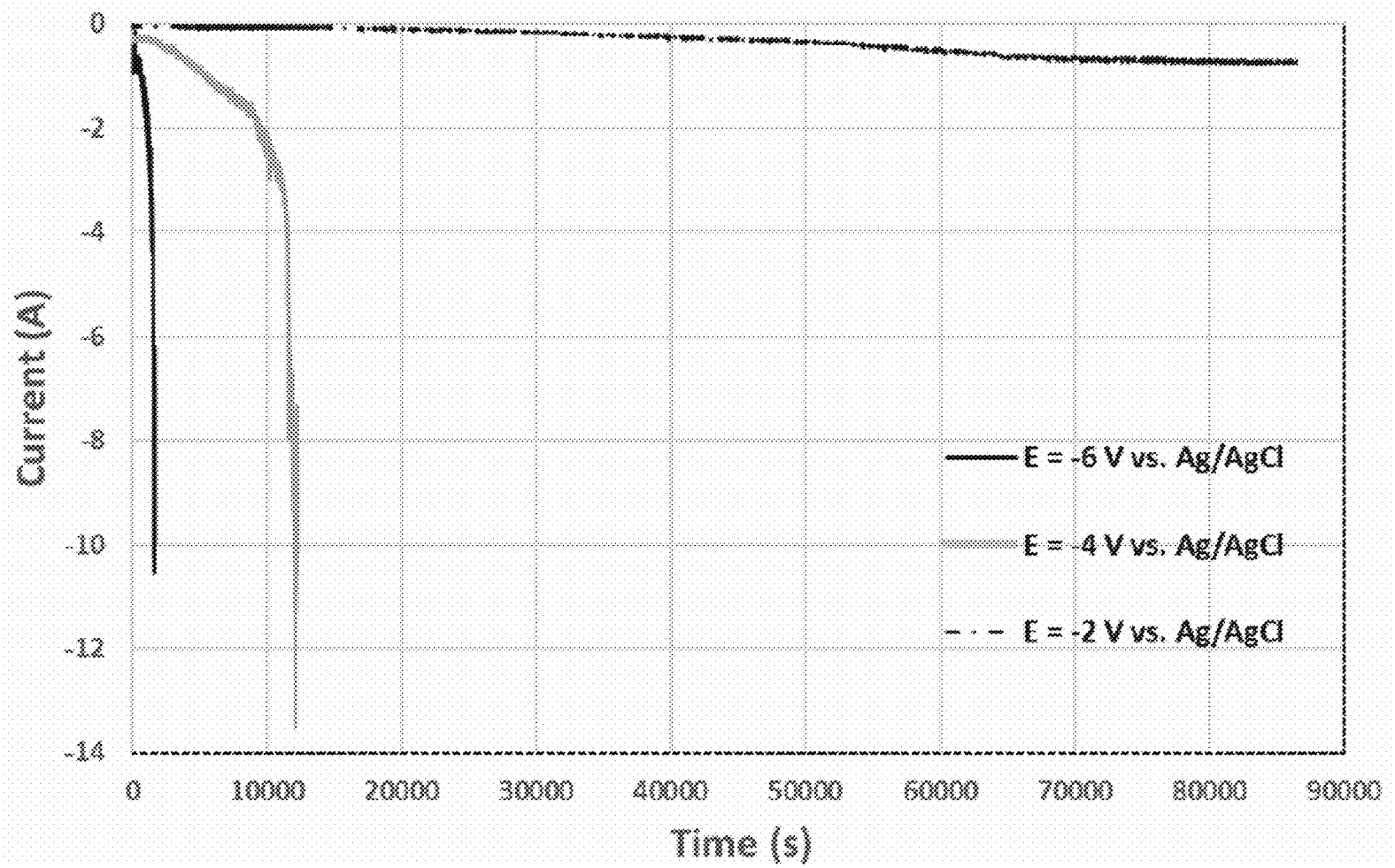
FIG. 2A Current vs. time profile of the activation of a Sn GDE at different potentials (E=−6V: black curve, E=−4 V: grey curve, E=−2 V: black dashed curve), FIG. 2B Cyclic voltammograms during activation of a Sn GDE via cycling between E=−1 V and E=−8 V FIG. 2C Potential and current vs. time profiles for the activation of a Sn GDE via application of potential steps from E=−1 V to E=−8 V with a step time of 5 s.
Figure 2B:
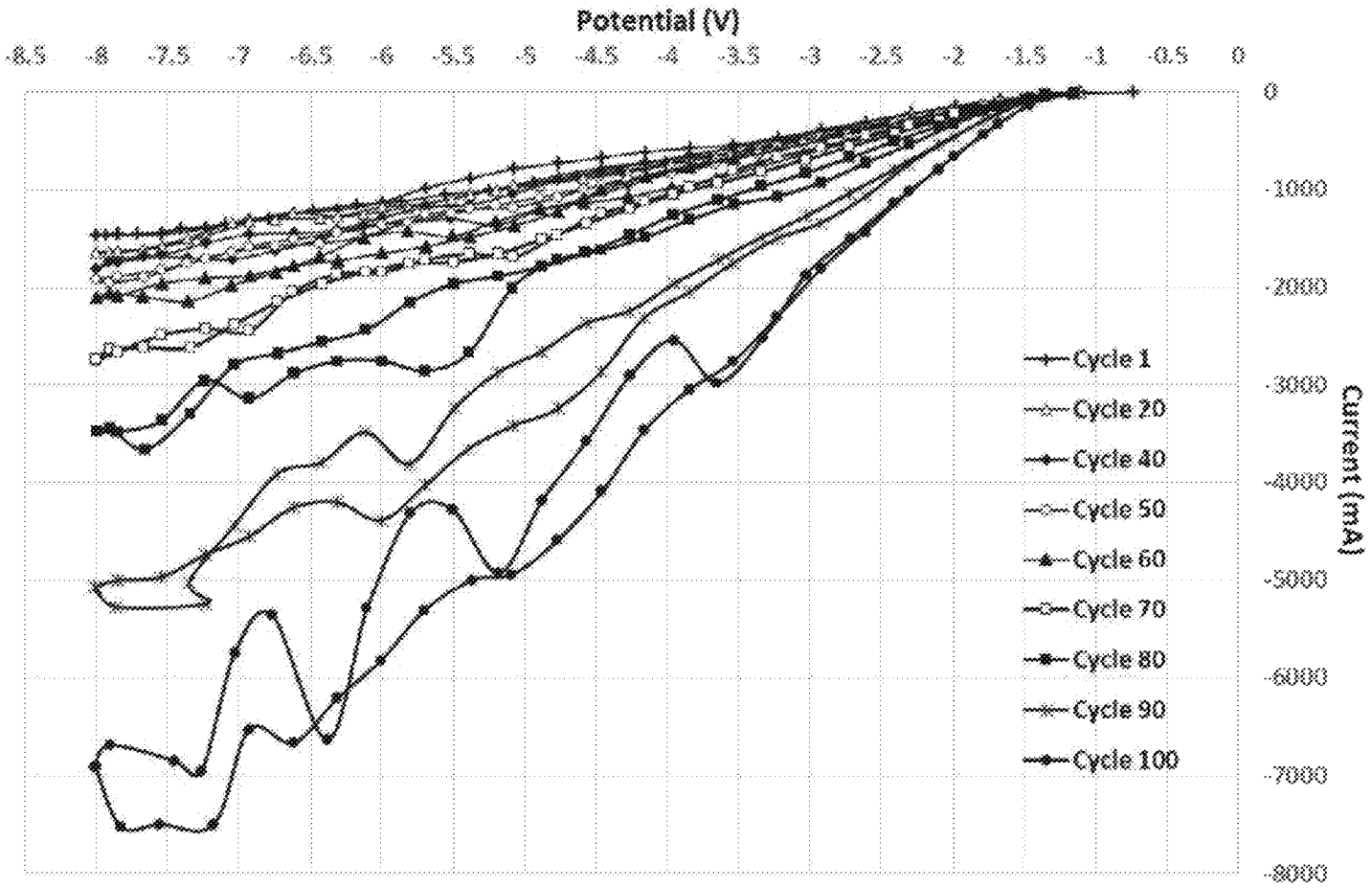
FIG. 2D Linear Sweep Voltammograms of Sn GDE in a microflowcell for respectively an untreated GDE (crosses) and an activated GDE (circles)
FIG. 2E Linear Sweep Voltammograms of Sn GDE in a microflowcell for respectively an untreated GDE (triangles), an activated GDE without $CO_2$ (crosses) and with $CO_2$ (circles).
Figure 2C:
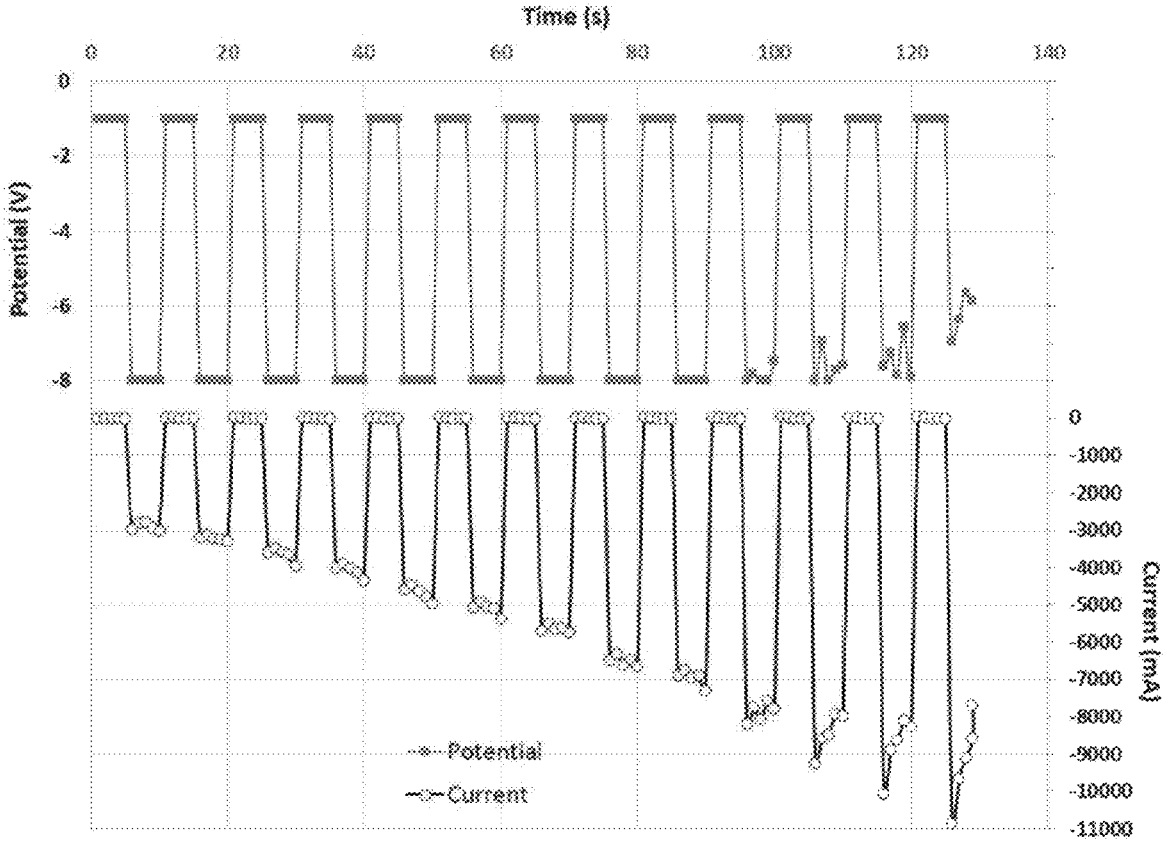
Figure 3:
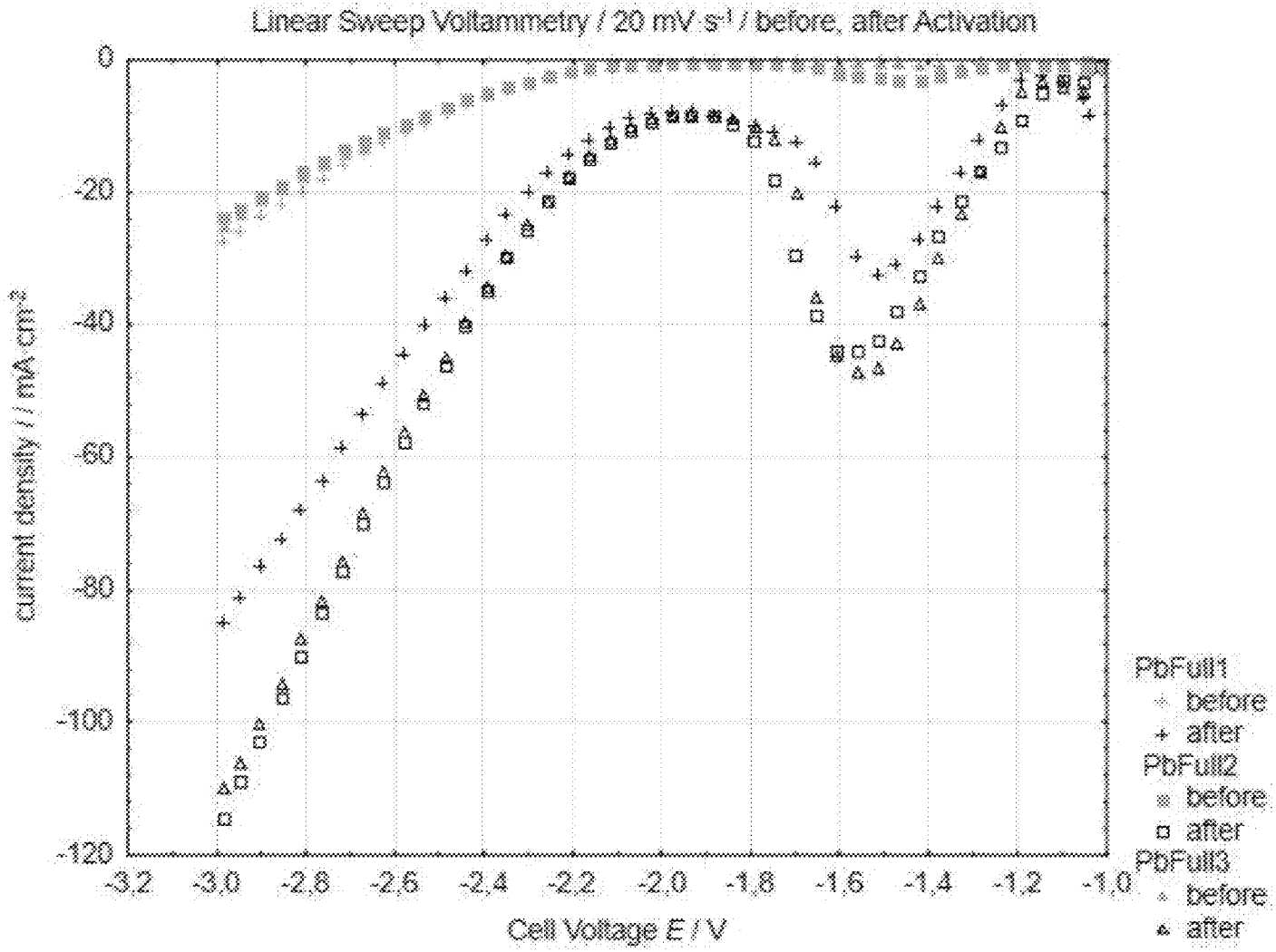

Below are the figures of the LSVs before and after activation (see "activation" step below) of the electrocatalyst. For Sn, the LSVs for two GDEs are provided, FIGS. 2B and 2C respectively. For Pb the before/after LSV's for three PB based GDEs are combined in a single Figure, FIG. 3, demonstrating the reproducibility of the CAGDL obtained using the method according to the invention.

For both the Sn or Pb based GDEs activation was done in a saturated KOH solution and a one compartment cell, 3 mL/min flow rate electrolyte, 50 ml/min $CO_2$ flow rate and a Dimensionally Stable Anode (DSA) as anode.

Electrochemical Experiments

Figure 2D:
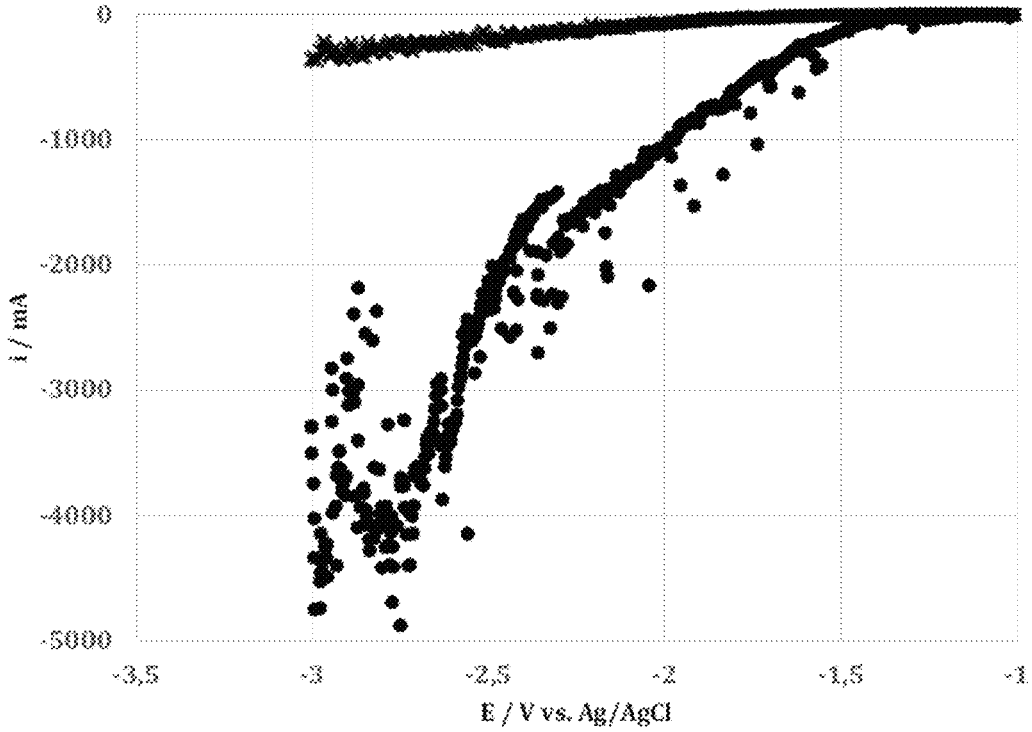
Figure 2E:
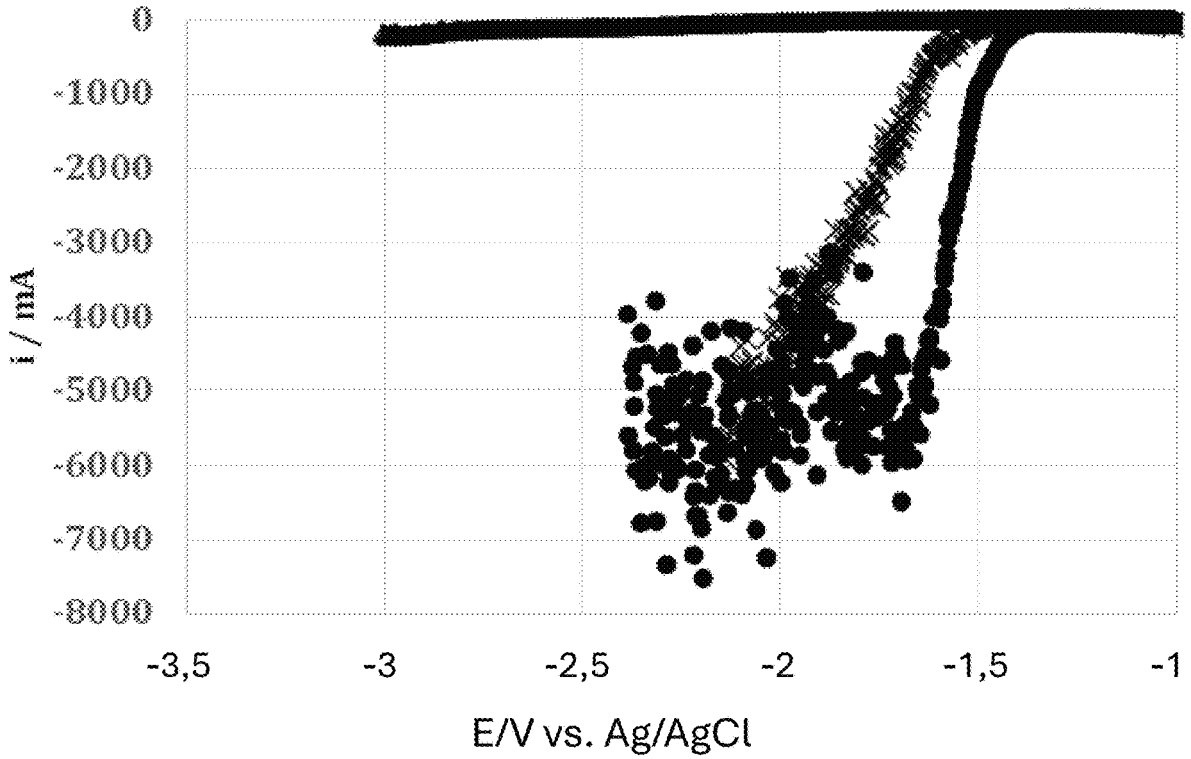

The FIGS. 2D and 2E show Linear Sweep Voltammetry (LSV) experiments recorded before and after electrochemical pretreatment involving electrical Joule heating. This pretreatment can be carried out via different procedures such as:

(1) by applying a constant potential at the electrode for a time until the current reaches absolute values larger than 10 A. The time needed for this activation procedure is dependent on the potential applied as depicted in FIG. 2A. Activation at a lower potential (E=−4V) requires longer times and if the potential is too low (E=−2 V), the required current is not obtained.

(2) by cycling between a certain potential range. In FIG. 2B cyclic voltammograms are shown for cycling the potential between E=−1 V and E=−8 V from which can be seen that the current increases with increasing cycle numbers. After around 100 cycles the current has reached absolute values>8 A indicating the Joule effect to have taken place.

(3) by applying potential steps to a value chosen such that the Joule effect can take place. In FIG. 2C the potential steps and corresponding current vs. time are shown. The potential steps are from E=−1V till E=−8V and last for 5 seconds. The current is increasing as a function of the time, indicating the activation of the electrode.

The experiments with the Sn GDE were carried out in a two-compartment flow cell with $CO_2$ saturated 0.5 M $KHCO_3$ as catholyte and 0.5-1 M KOH as anolyte. The counter electrode was a platinized tantalum plate and the potential was measured with respect to a Ag/AgCl reference electrode. The activation via cycling (FIG. 2B) was per-formed at a scan rate of 500 mV/s/. For the Pb GDE, the LSV was recorded at a scan rate of 20 mV/s in a one compartment cell employing 6 M KOH. The shown electrode potential (FIG. 3) is measured against the mixed metal oxide anode. The LSV was recorded with a 3 mL/min electrolyte flow rate with a $CO_2$ gas flow rate of 50 mL/min.

Results & Discussion

The measured current at a given potential is significantly increased when comparing the LSV before and after activation (FIG. 2D). This indicates a significant increase in activity (towards $CO_2$ reduction, FIG. 2E) of the GDE, likely due to an increase of the accessible electrochemical active sites in the GDE.

Characterization of the Sn Based GDEs

X-ray Diffraction (XRD) measurement of the Sn based carbon free GDE before (pristine) and after activation shown a decrease in the intensity of tin present in the bulk of the electrode. This is also apparent from an X-ray Photoelectron Spectroscopy (XPS) analysis of the material before and after activation.

From the XPS analysis it can be seen that the overall Sn content slightly decreases after activation (FIG. 4A). Furthermore, the F content decreases (FIG. 4B) which is a result of the electrochemical sintering (activation) process. FIG. 4A further indicates an increase in K and Cl content after activation. This is ascribed to these species being present in the electrolyte which are adsorbed onto the electrode during activation since the electrode is immersed in the electrolyte.

The Teflon (PTFE) content decreases leading to an increased conductivity, as can be seen from Table 1, showing the in-plane resistance of the Sn based carbon free GDE before (pristine) and after activation. After activation the resistance has significantly decreased, indicating an increase in conductivity by the activation procedure.

TABLE 1

| In-plane resistance of Sn GDEs<br>In-plane resistance | |
|---|---|
| Pristine electrode | Activated electrode |
| 1-10 MOhm | <1 Ohm |

That the activation effectively alters the GDE, is also apparent from Scanning Electron Microscopy (SEM) images of the GDE before and after activation (FIG. 5). On the pristine electrode (top images in FIG. 5) relatively large Sn particles can be observed, while on the activated electrode much smaller Sn particles are visible. This is caused by melting followed by recrystallization of the Sn particles during the electrochemical sintering process leading to a well-dispersed distribution of nanostructured Sn which accounts for a better conductivity. Moreover, a more porous structure of the GDL is visible after activation.

The invention claimed is:

1. A Gas Diffusion Electrode (GDE) comprising a Catalytic Activated Gas Diffusion Layer (CAGDL), wherein the CAGDL comprises an electrochemically fully activated Gas Diffusion Layer (GDL) comprising a catalytic material homogenously distributed within the fully activated GDL, the fully activated GDL further comprising a porous binder material, wherein the catalytic material is present within the activated GDL in the absence of a conductive carbon support for the catalytic material, and in the absence of a current collector or current distributor, and wherein the catalytic material comprises a metal selected from Sn, Cd, Zn, Pb, Sb, Bi, or a eutectic composition comprising two or more of the metals and is present withing the fully activated GDL as recrystallized nanostructured particles.

2. The GDE according to claim 1, wherein the porous binder material is a polymeric porous material.

3. The GDE according to claim 1, wherein the porous binder material is a thermoplastic porous material.

4. The GDE according to claim 1, wherein the porous binder material is polytetrafluoroethylene (PTFE).

5. The GDE according to claim 1, wherein the catalytic material in the GDE comprises the eutectic composition of Zn—Sn or Bi—Sn.

6. The GDE according to claim 1, wherein the recrystallized nanostructured particles have all three dimensions in an average length from about 1 nm to about 100 nm.

7. The GDE according to claim 1, wherein the catalytic material is included as a metallic powder to the porous binder material.

8. The GDE according to claim 1, wherein the CAGDL comprises about 50 wt %-80 wt % of the catalytic material.

* * * * *